US008793841B2

(12) United States Patent
DeBerry et al.

(10) Patent No.: US 8,793,841 B2
(45) Date of Patent: Aug. 5, 2014

(54) BUCKLE WITH STRAPPING SUPPORTS

(75) Inventors: Earl J. DeBerry, Joliet, IL (US); John J. Bulanda, New Lenox, IL (US); Michael G. Mayo, New Lenox, IL (US)

(73) Assignee: Panduit Corp., Tinley Park, IL (US)

( * ) Notice: Subject to any disclaimer, the term of this patent is extended or adjusted under 35 U.S.C. 154(b) by 347 days.

(21) Appl. No.: 12/874,716

(22) Filed: Sep. 2, 2010

(65) Prior Publication Data

US 2012/0054991 A1 Mar. 8, 2012

(51) Int. Cl.

| | |
|---|---|
| ***B65D 63/00*** | (2006.01) |
| ***B65D 63/16*** | (2006.01) |
| ***B65D 63/08*** | (2006.01) |
| ***A44B 11/12*** | (2006.01) |

(52) U.S. Cl.

CPC ..... *A44B 11/12* (2013.01); *B65D 63/16* (2013.01); *B65D 63/08* (2013.01)

USPC ..... 24/23 W; 24/23 R

(58) Field of Classification Search

USPC ..... 24/703.1, 23 R, 23 B, 23 W, 20 R, 22

See application file for complete search history.

(56) References Cited

U.S. PATENT DOCUMENTS

| | | | | |
|---|---|---|---|---|
| 1,855,007 A | | 4/1932 | Bradley | |
| 2,533,275 A | * | 12/1950 | McAneny Michael J | 24/23 B |
| 2,870,503 A | | 1/1959 | McAneny | |
| 2,882,934 A | | 4/1959 | Gerrard | |
| 3,155,355 A | | 11/1964 | Cappola | |
| 3,964,133 A | * | 6/1976 | Wasserlein, Jr. | 24/23 R |
| 4,015,311 A | | 4/1977 | Curtis | |
| 4,288,100 A | | 9/1981 | Aho | |
| 4,765,032 A | | 8/1988 | Fortsch | |
| 4,866,817 A | | 9/1989 | Espevik et al. | |
| 4,896,402 A | | 1/1990 | Jansen et al. | |

(Continued)

FOREIGN PATENT DOCUMENTS

| | | |
|---|---|---|
| DE | 2007232 A1 | 9/1971 |
| EP | 0094168 A1 | 11/1983 |
| FR | 2547707 A1 | 12/1984 |

OTHER PUBLICATIONS

Band-It® Buckles, Ear-Lokt Style, http://www.band-it-idex.com/en/products/Band%20%26%20Buckle/Ear-Lokt%20Buckles.html, last visited Jul. 26, 2010, 2 pages.

Band-It® The Clamping Experts, Forming a Band Clamp and Operating the C001 Tool, http://www.band-it-idex.com/en/Tools%20%26%20Resources/Brochures/C00169bandinginstructions.pdf, last visited Jul. 26, 2010, 2 pages.

(Continued)

*Primary Examiner* — Robert J Sandy
*Assistant Examiner* — Abigail Morrell
(74) *Attorney, Agent, or Firm* — Christopher S. Clancy; James H. Williams

(57) ABSTRACT

A buckle for fastening opposing ends of an object encircling strap is provided. The buckle includes a deformable retainer and a bridge. The deformable retainer defines an entrance passageway for a free end of the strap and includes a retainer tab, an opening adjacent the retainer tab, and a pair of strapping supports spaced apart from the opening. The bridge defines an exit passageway for the free end of the strap. The free end of the strap is positionable around an object and consecutively through the entrance passageway and the exit passageway. The free end of the strap is bendable over the bridge and between the strapping supports and the opening such that the free end of the strap curls when the retainer is deformed.

10 Claims, 12 Drawing Sheets

(56) References Cited

U.S. PATENT DOCUMENTS

| | | | |
|---|---|---|---|
| 5,127,446 | A | 7/1992 | Marelin |
| 5,322,091 | A | 6/1994 | Marelin |
| 5,483,998 | A | 1/1996 | Marelin et al. |
| 6,014,792 | A | 1/2000 | Marelin et al. |
| 7,171,729 | B2 | 2/2007 | Bulanda et al. |
| 7,392,570 | B2 | 7/2008 | Bulanda et al. |

OTHER PUBLICATIONS

Band-It® The Clamping Experts C00169 Hand Tool Operating Instructions, http://www.band-it-idex.com/en/Tools%20%26%20Resources/Tool_Instructions/P05886.pdf, last visited Jul. 26, 2010, 4 pages.

* cited by examiner

BUCKLE WITH STRAPPING SUPPORTS

BACKGROUND OF THE INVENTION

The present invention relates to a buckle, preferably a metal buckle, for fastening opposing ends of an object encircling strap. Metal buckles, as opposed to buckles made of other materials, such as plastic, are characterized by desirable properties, such as high tensile strength, high and low temperature resistance, abrasion resistance, corrosion resistance, and radiation resistance. A variety of buckles, such as Panduit® Pan-Steel® buckles and Band-It® Ear-Lokt buckles, are known. The Panduit® Pan-Steel® buckles are related to U.S. Pat. Nos. 4,866,817, 7,171,729, and 7,392,570, which are incorporated by reference in their entireties.

While known buckles provide desirable characteristics for certain applications, they still have many drawbacks and are capable of improvement.

SUMMARY OF THE INVENTION

Certain embodiments of the present invention provide a buckle for fastening opposing ends of an object encircling strap. The buckle includes a deformable retainer and a bridge. The deformable retainer defines an entrance passageway for a free end of the strap and includes a retainer tab, an opening adjacent the retainer tab, and a pair of strapping supports spaced apart from the opening. The bridge defines an exit passageway for the free end of the strap. The free end of the strap is positionable around an object and consecutively through the entrance passageway and the exit passageway. The free end of the strap is bendable over the bridge and between the strapping supports and the opening such that the free end of the strap curls when the retainer is deformed.

DETAILED DESCRIPTION

FIGS. 1-19 illustrate a buckle and strap fastener 100 for fastening an object 10, such as a bundle of cables 20, according to an embodiment of the present invention.

Figure 1:
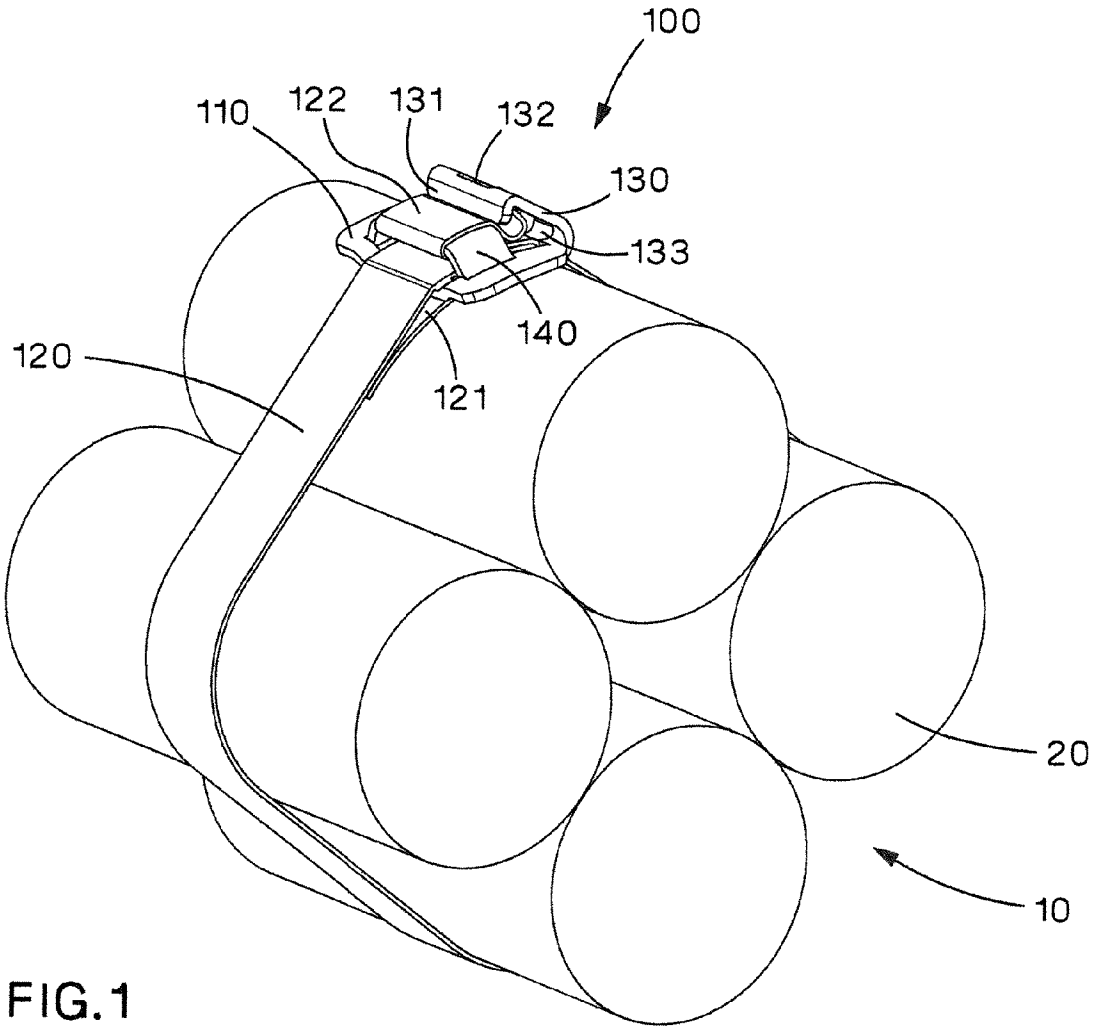
FIG. 1 is a perspective view of a buckle and strap fastener in a fully assembled state according to an embodiment of the present invention.
Figure 2:
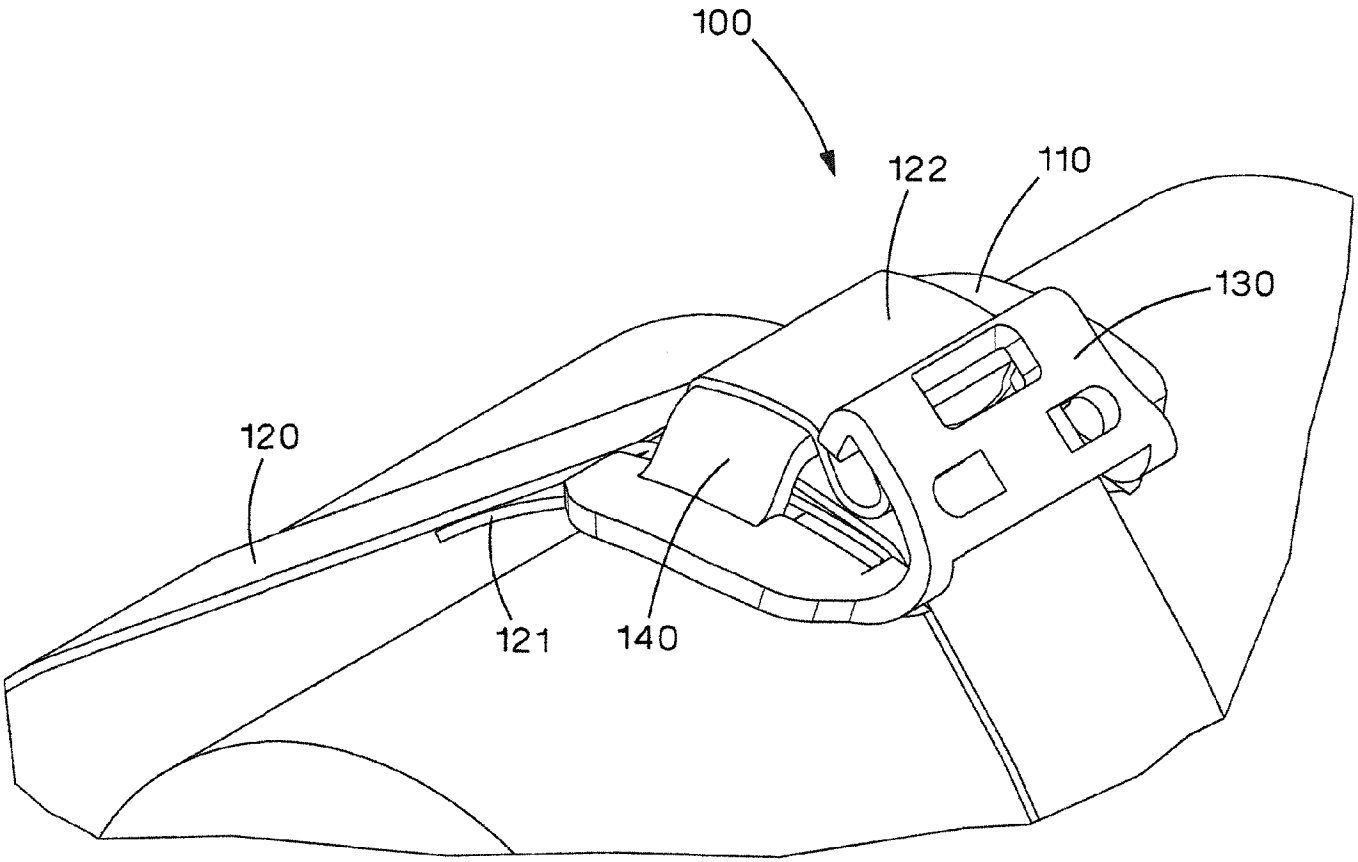
FIG. 2 is a partial view of the buckle and strap fastener of FIG. 1, showing the buckle.
Figure 3:
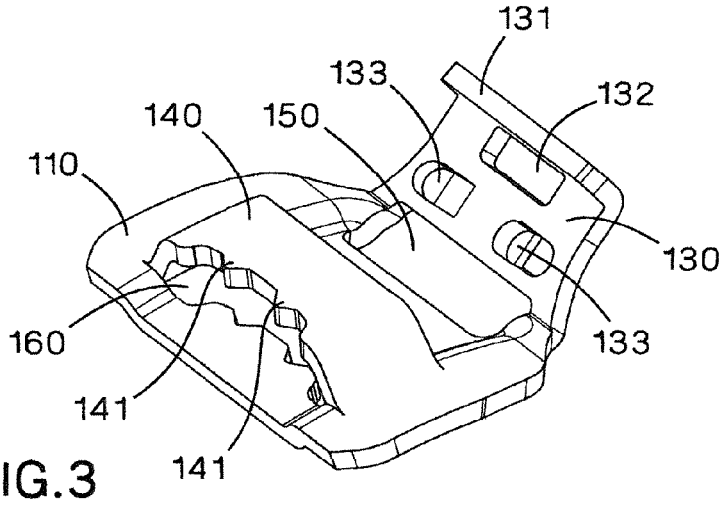
FIG. 3 is a perspective view of the buckle of FIG. 2.
Figure 4:
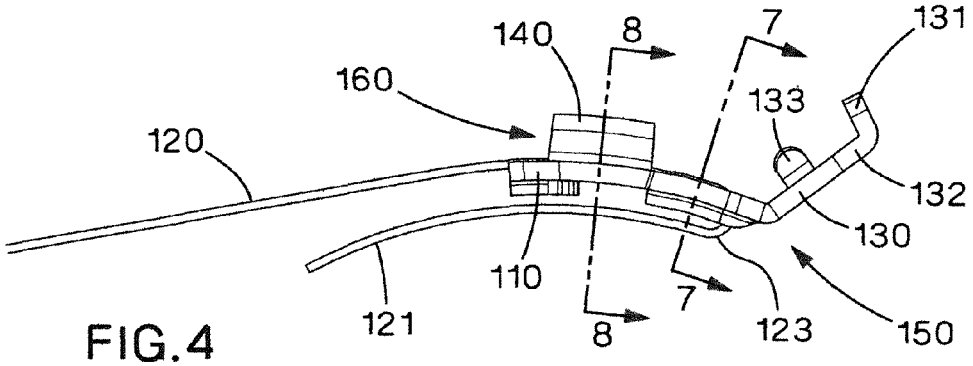
FIG. 4 is a side view of the buckle of FIG. 2, showing the fixed end of a strap secured to the buckle.

As shown in FIGS. 1 and 2, the buckle and strap fastener 100 includes a buckle 110 and a strap 120. Preferably, the buckle 110 and the strap 120 are made of metal, such as stainless steel, but it is likewise contemplated that the buckle 110 and the strap 120 are made of plastic, such as nylon, or other suitable materials.

Figure 9:
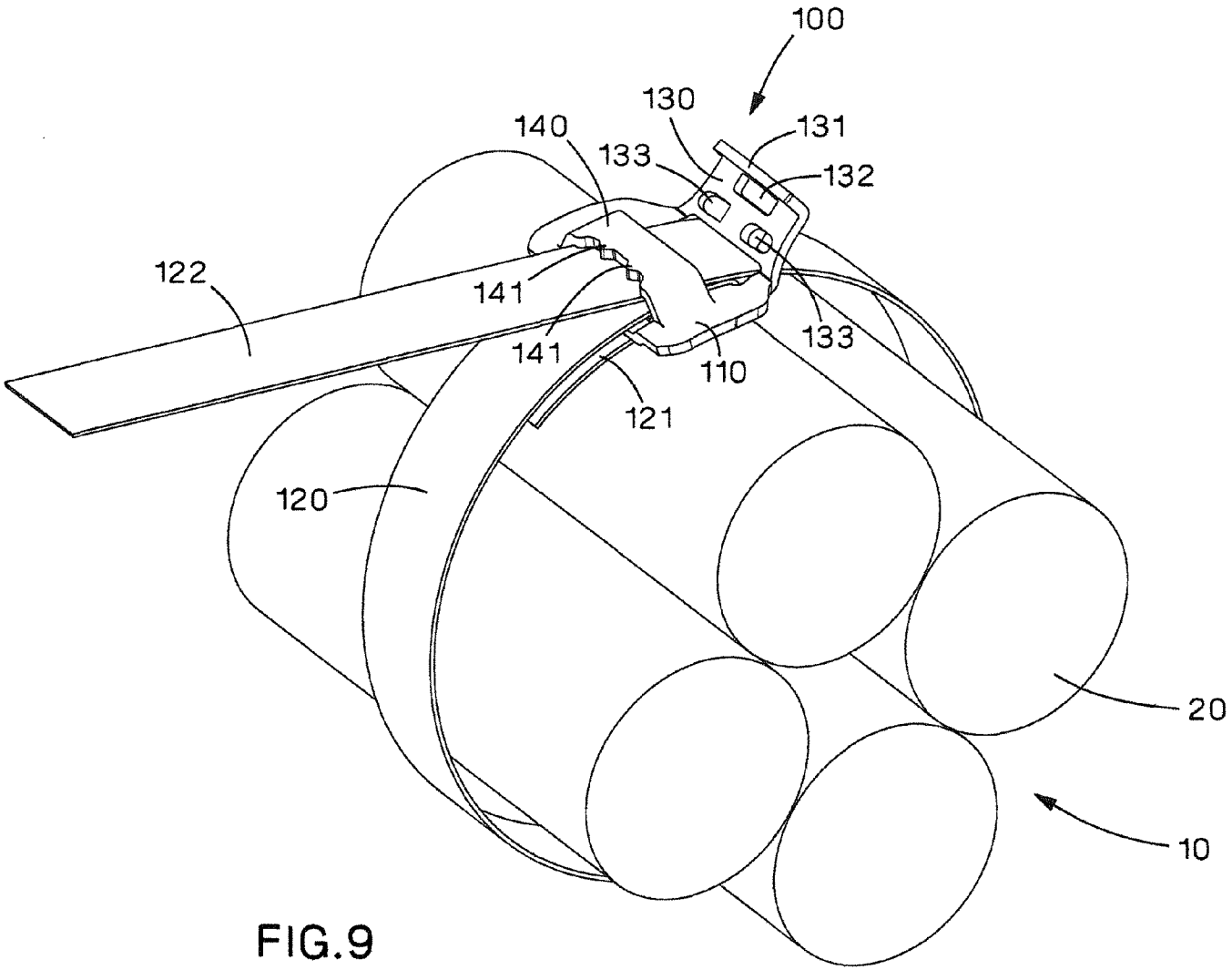
FIG. 9 is a perspective view of the buckle and strap fastener of FIG. 1 in a partially assembled state.
Figure 10:
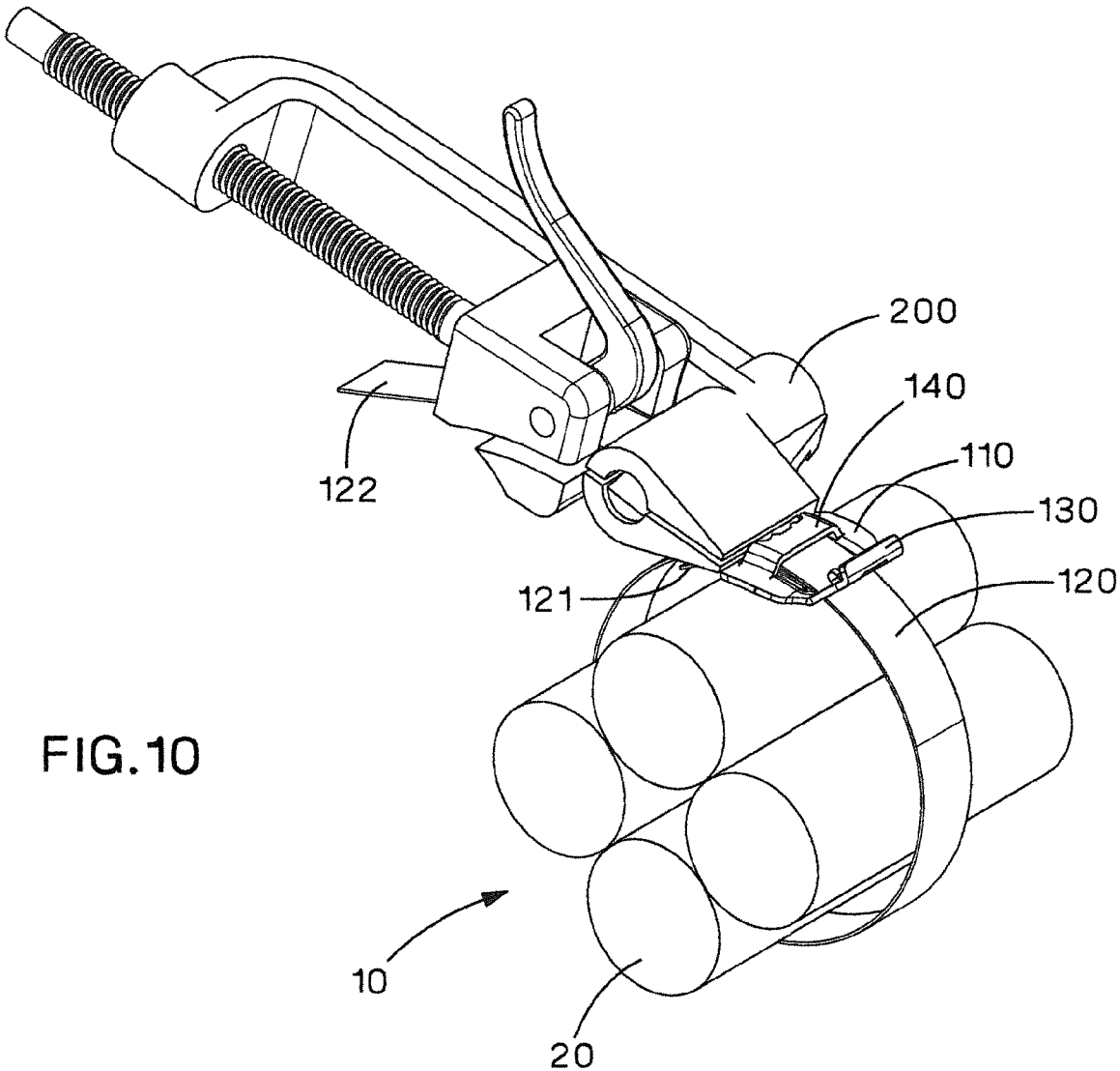
FIG. 10 is a perspective view of the buckle and strap fastener of FIG. 9, showing the free end of the strap positioned in the applicator tool.
Figure 11:
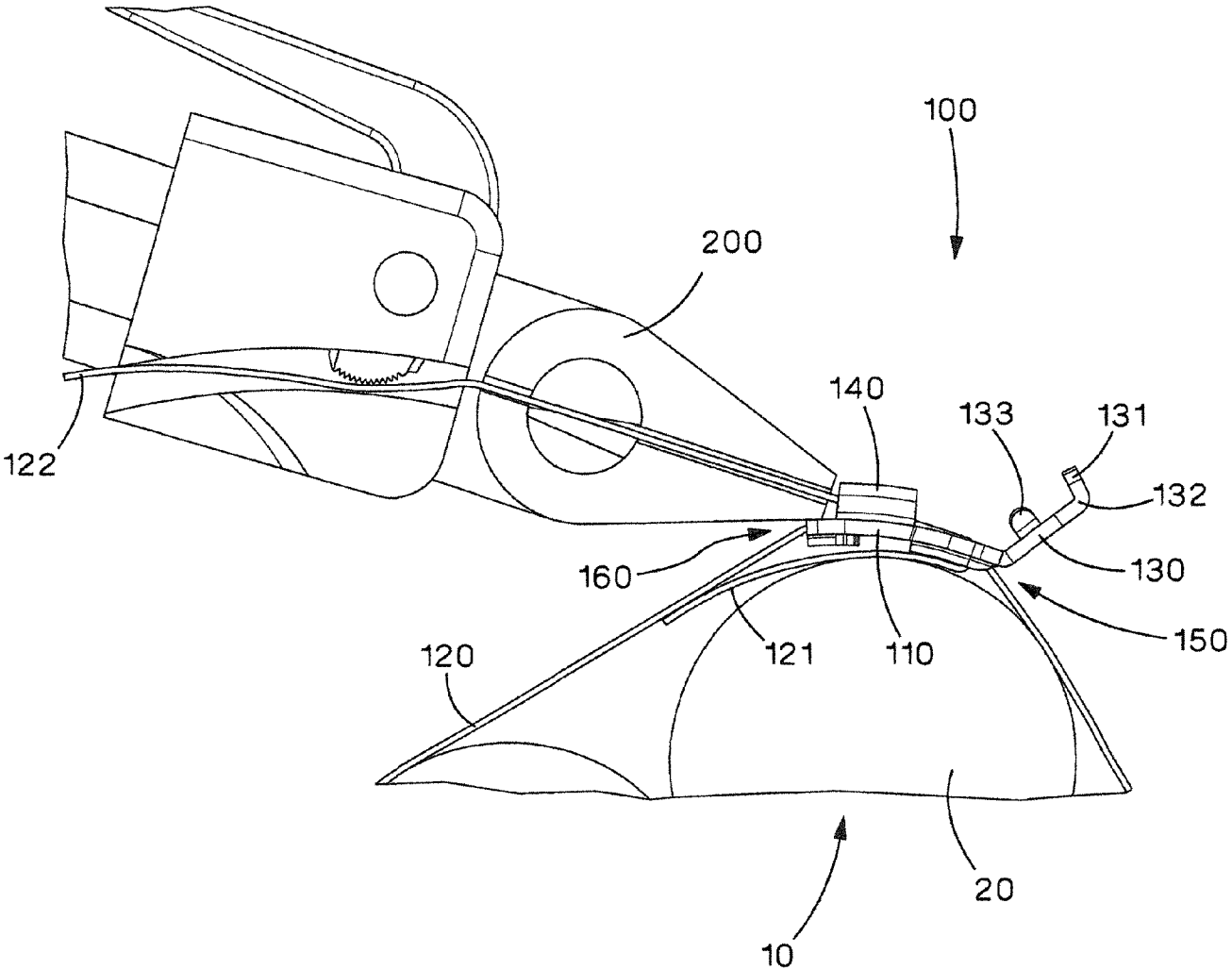
FIG. 11 is a partial side view of the buckle and strap fastener of FIG. 10, showing the applicator tool tensioning the free end of the strap.

The strap 120 includes a fixed end 121, which is fixed to the buckle 110 (FIG. 6), and a free end 122 opposite the fixed end 121, which is free to encircle the object 10 (FIG. 9).

Figure 5:
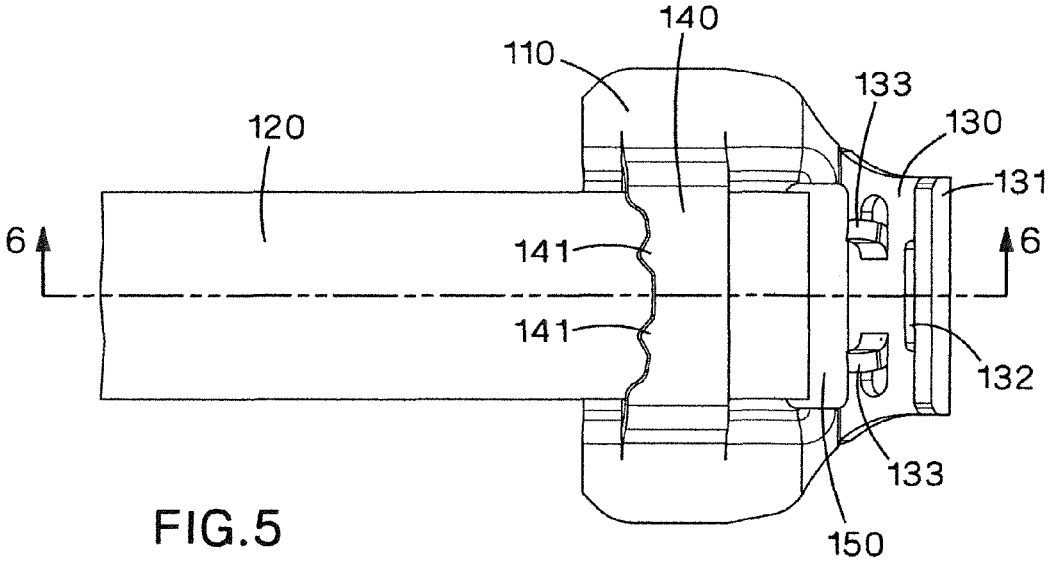
FIG. 5 is a top view of the buckle of FIG. 4.
Figure 6:
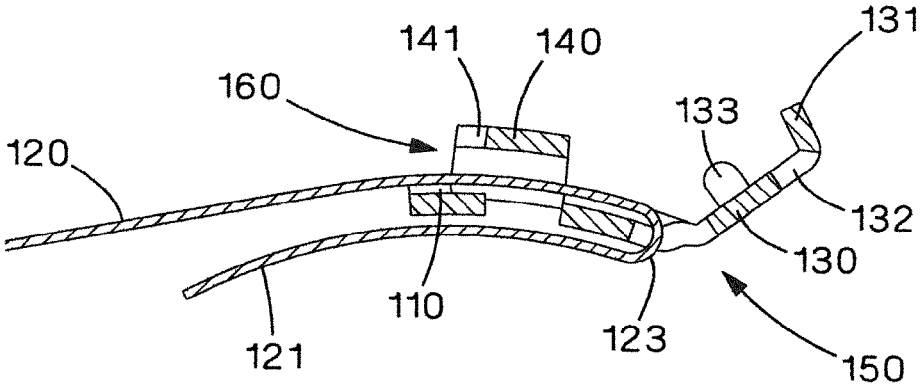
FIG. 6 is a sectional view of the buckle taken along line 6-6 of FIG. 5.
Figure 7:
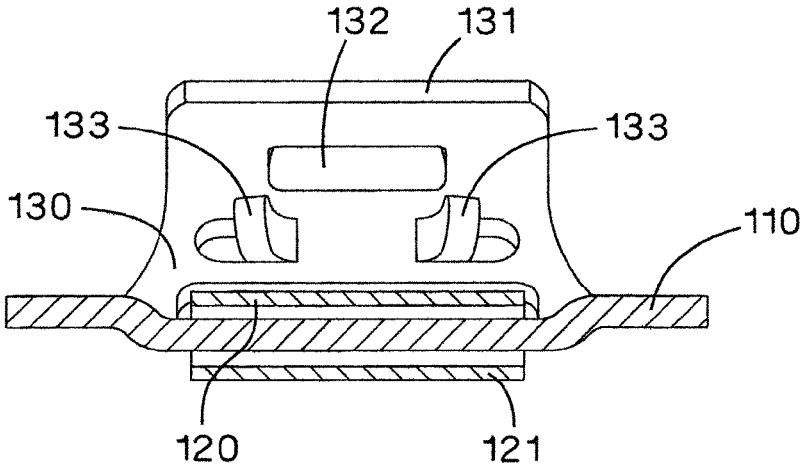
FIG. 7 is a sectional view of the buckle taken along line 7-7 of FIG. 4.
Figure 8:
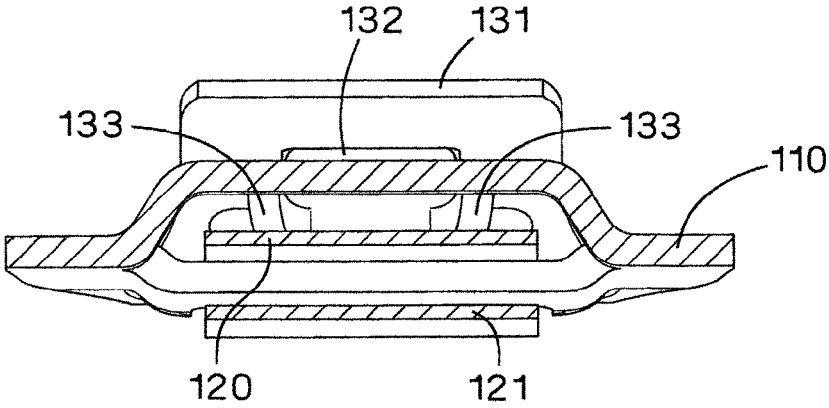
FIG. 8 is a sectional view of the buckle taken along line 8-8 of FIG. 4.

As shown in FIGS. 3-9, the buckle 110 includes a deformable retainer 130 and a bridge 140. The deformable retainer 130 defines an entrance passageway 150 for the free end 122 of the strap 120 (FIG. 6). The reduced area of the deformable retainer 130 at the entrance passageway 150 facilitates deformation of the deformable retainer 130 about an axis transverse to the longitudinal axis of the strap 120. The bridge 140 defines an exit passageway 160 for the free end 122 of the strap 120 (FIG. 6).

The deformable retainer 130 includes a retainer tab 131, an opening 132 adjacent the retainer tab 131, and a pair of strapping supports 133 spaced apart from the opening 132. The retainer tab 131 is disposed on the distal end of the deformable retainer 130 and extends inwardly relative to the buckle 110. The strapping supports 133 are disposed along an axis transverse to the longitudinal axis of the strap 120 and also extend inwardly relative to the buckle 110. Preferably, the strapping supports 133 are shear formed in opposite directions along the transverse axis. Alternatively, the strapping supports 133 are shear formed in the same direction along the transverse axis.

As shown in FIGS. 2 and 5, the bridge 140 includes a plurality of teeth 141 for engaging the free end 122 of the strap 120. Preferably, the teeth 141 are inset relative to the outer edge of the bridge 140 (FIG. 5).

Figure 12:
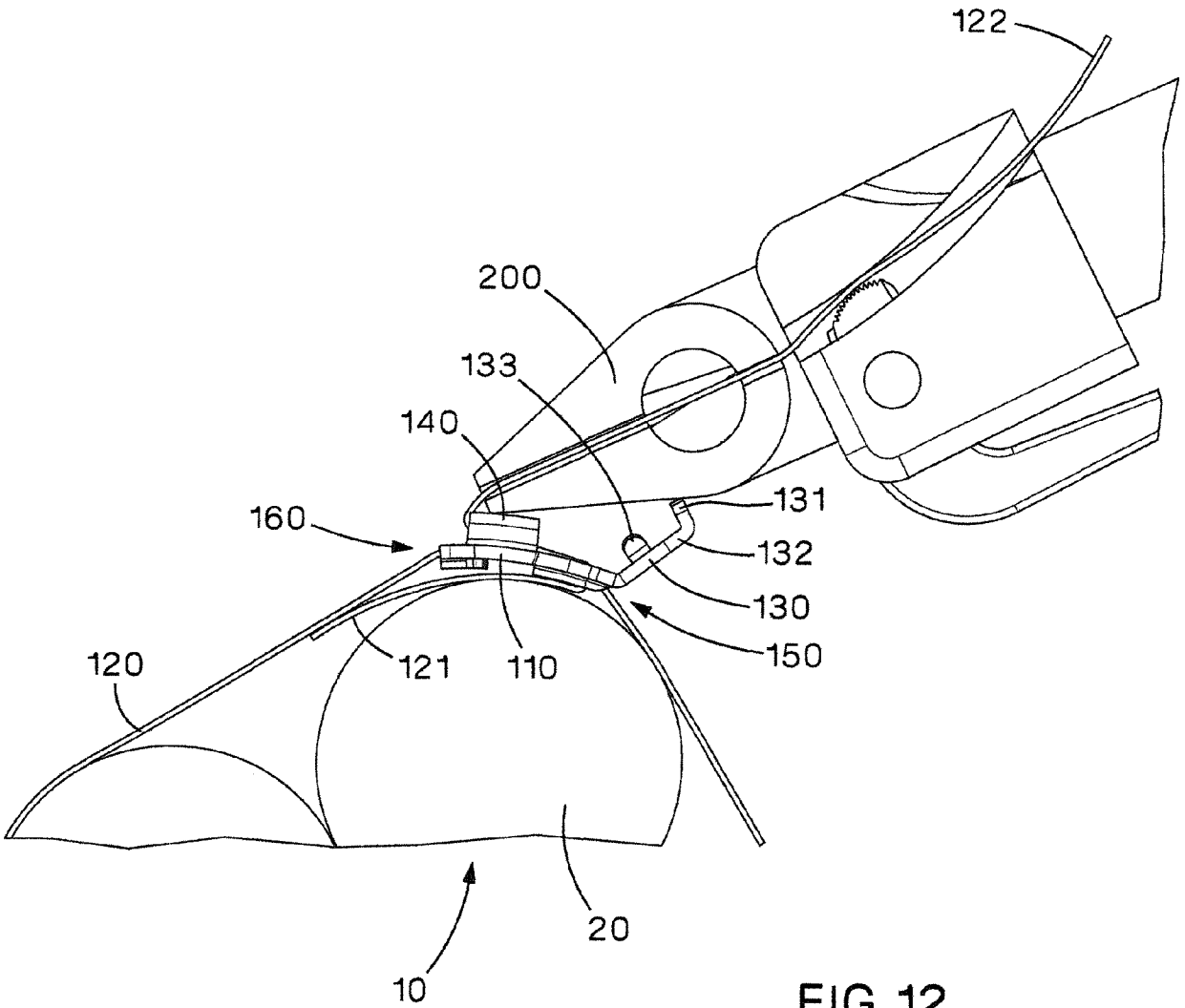
FIG. 12 is a partial side view of the buckle and strap fastener of FIG. 10, showing the applicator tool folding the free end of the strap over the buckle after tensioning.
Figure 13:
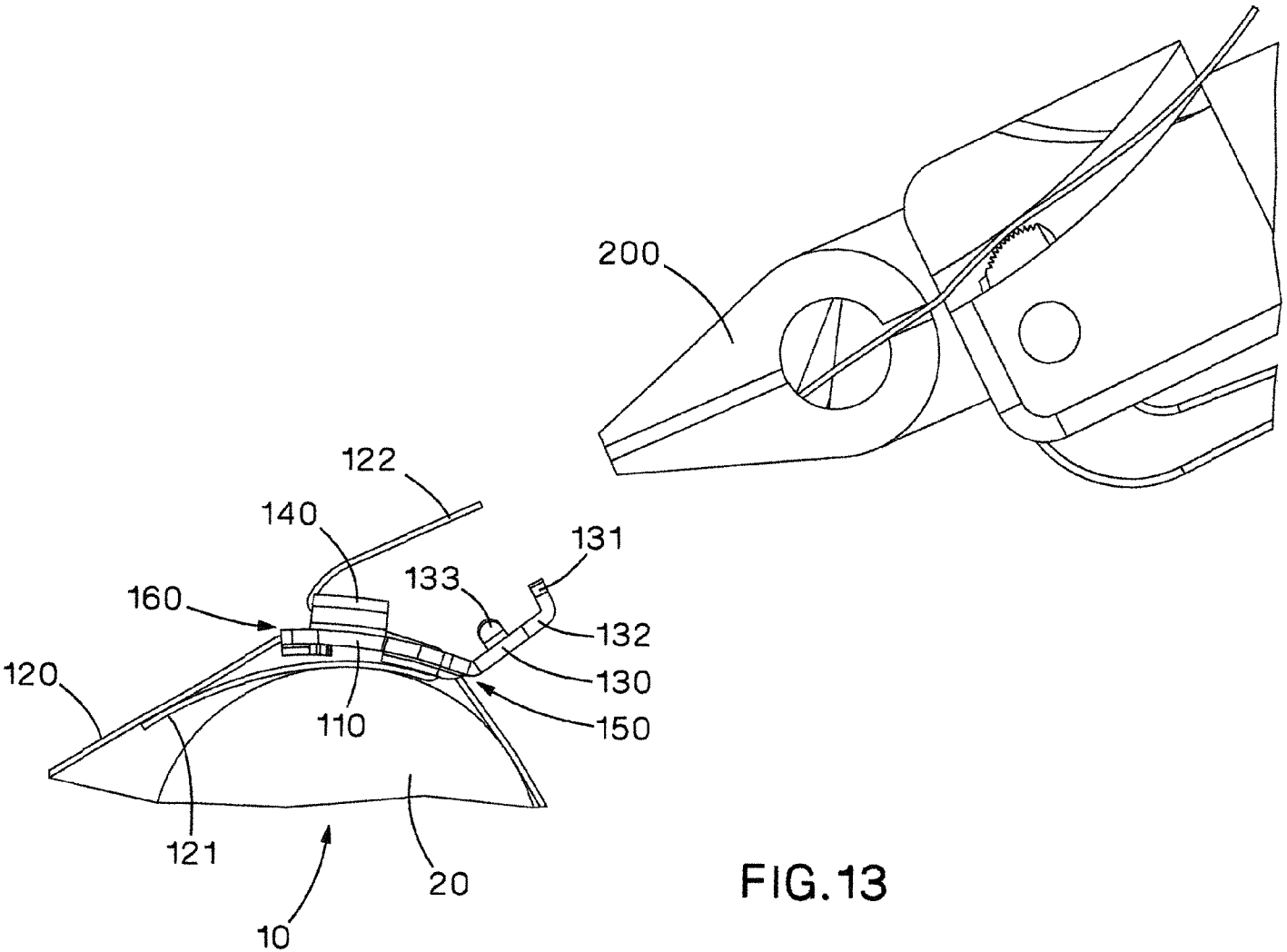
FIG. 13 is a partial side view of the buckle and strap fastener of FIG. 10, showing the applicator tool severing the free end of the strap.
Figure 14:
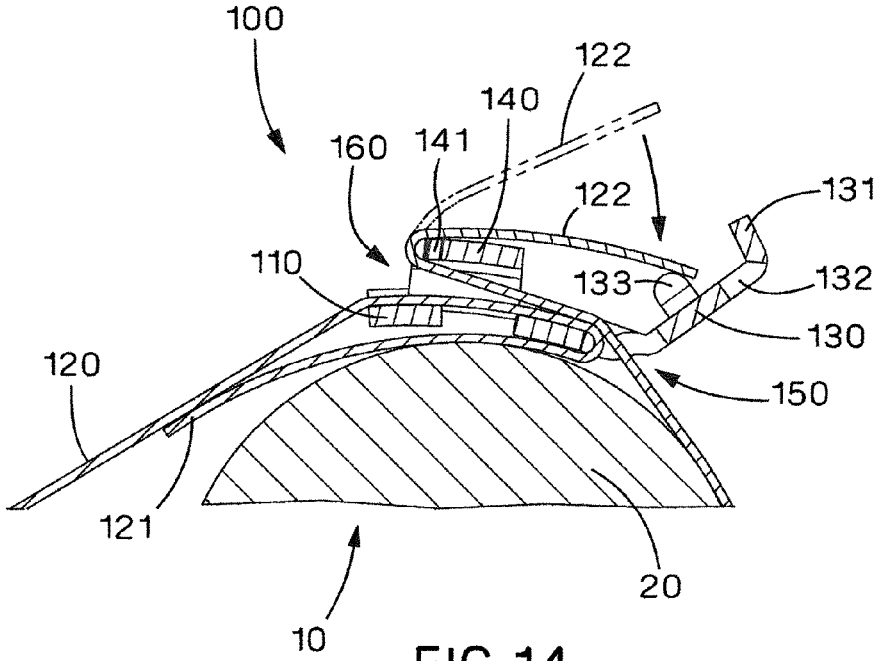
FIG. 14 is a partial side sectional view of the buckle and strap fastener of FIG. 10, showing the free end of the strap being bent over the bridge and between the openings and the strapping supports.
Figure 15:
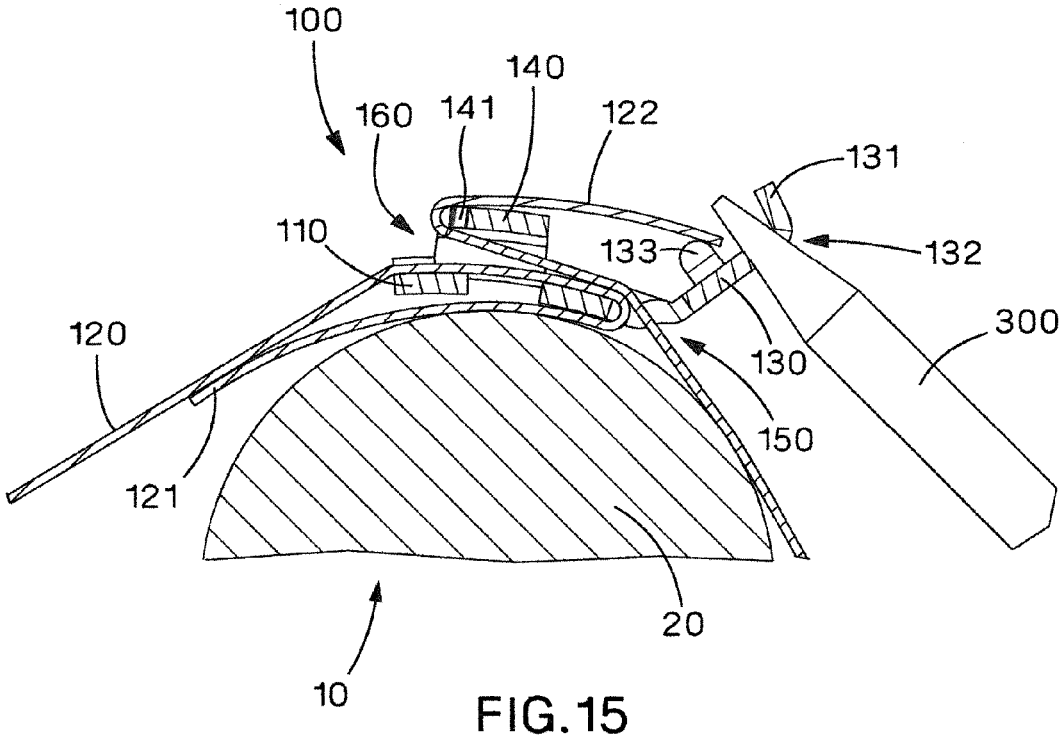
FIG. 15 is a partial side sectional view of the buckle and strap fastener of FIG. 10, showing the retainer deformation tool positioned in the opening of the retainer between the retainer tab and the free end of the strap.
Figure 16:
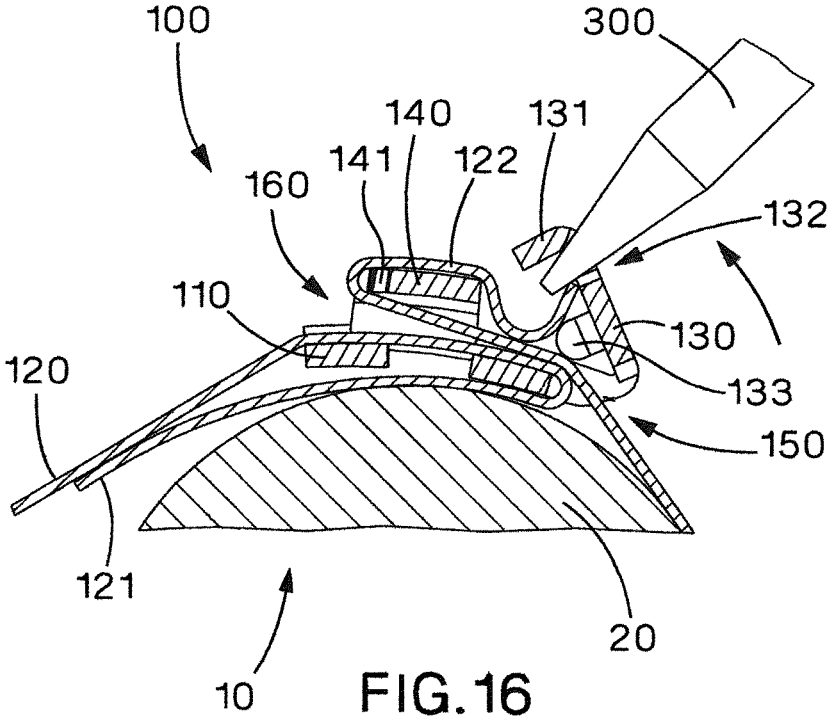
FIG. 16 is a partial side sectional view of the buckle and strap fastener of FIG. 10, showing the retainer and the free end of the strap in a partially deformed state.
Figure 17:
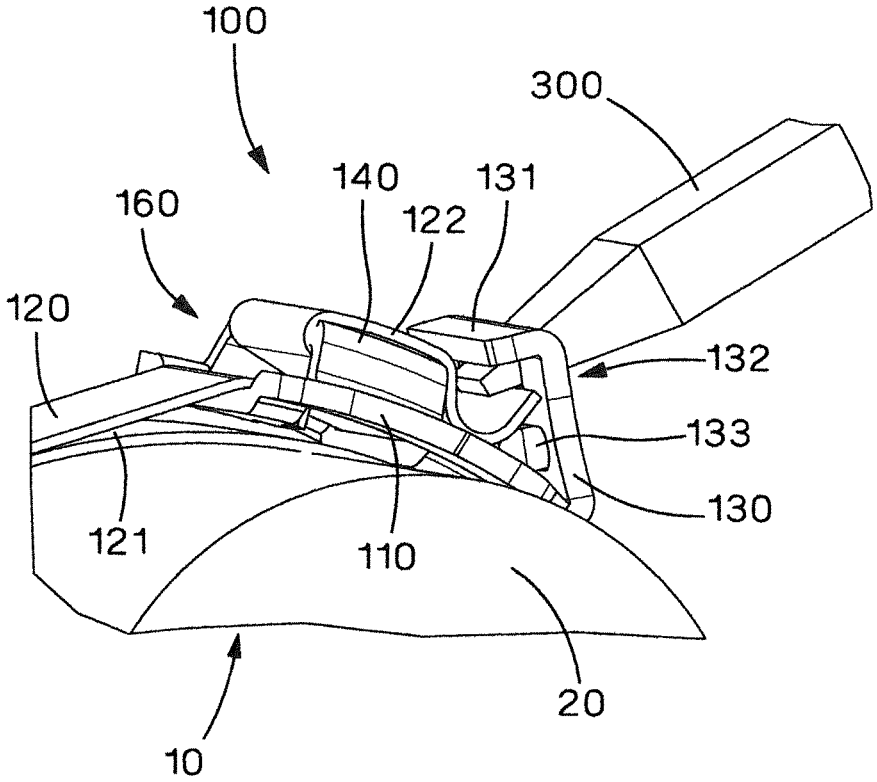
FIG. 17 is a perspective view of the buckle and strap fastener of FIG. 16.
Figure 18:
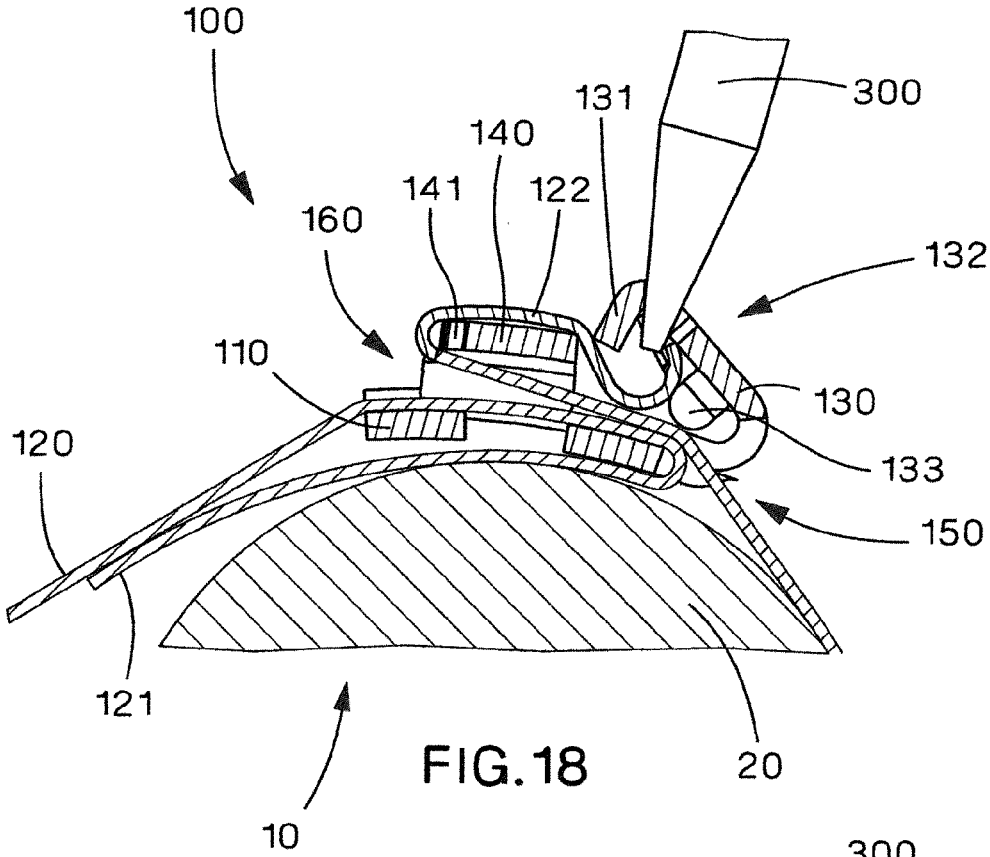
FIG. 18 is a partial side sectional view of the buckle and strap fastener of FIG. 10, showing the retainer and the free end of the strap in a fully deformed state.
Figure 19:
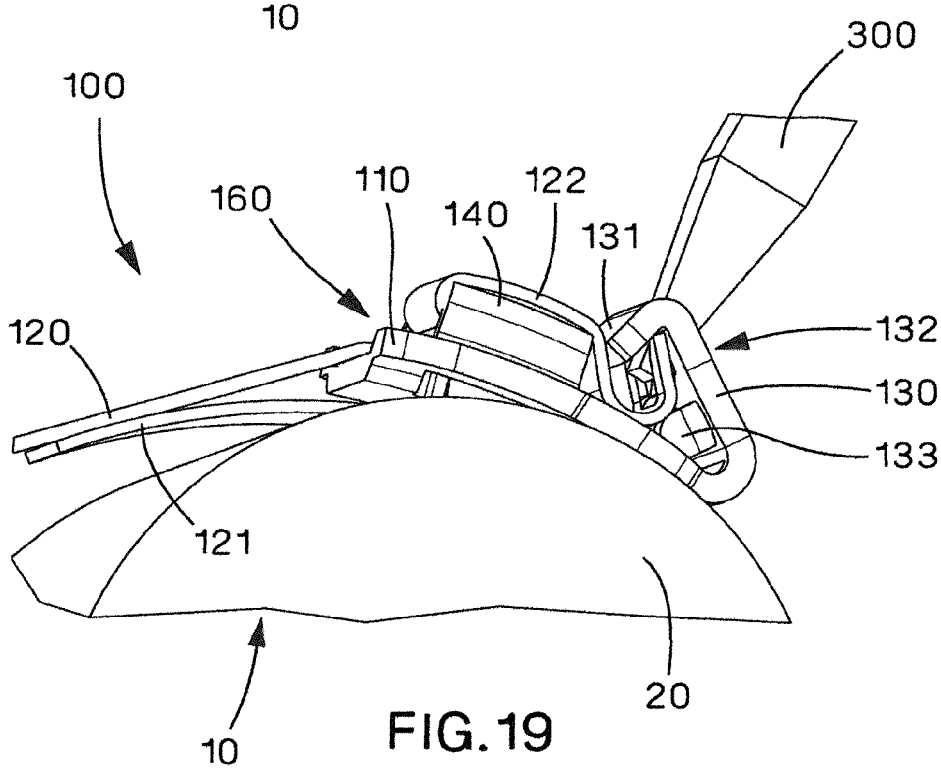
FIG. 19 is a perspective view of the buckle and strap fastener of FIG. 18.

With reference to FIGS. 6 and 9-19, application of the buckle and strap fastener 100 is as follows: the buckle 110 is initially secured to the strap 120 by inserting the fixed end 121 of the strap 120 through the buckle 110 and forming a fold 123 in the fixed end 121 of the strap 120 with the free end 122 of the strap 120 exiting the buckle 110 from the exit passageway 160 of the bridge 140 (FIG. 6). The free end 122 of the strap 120 is positioned around the object 10 and consecutively through the entrance passageway 150 of the deformable retainer 130 and the exit passageway 160 of the bridge 140 (FIG. 9). The free end 122 of the strap 120 is then positioned in an applicator tool 200 (FIG. 10), such as the applicator tool disclosed in U.S. Pat. No. 7,089,970, which is incorporated by reference in its entirety. The applicator tool 200 tensions the strap 120 (FIG. 11), and then folds the strap 120 over the outer edge of the bridge 140 (FIG. 12). The teeth 141 bite into the strap 120, fixing the strap 120 relative to the buckle 110 to prevent relaxation of the induced tension. After the strap 120 is tensioned, the applicator tool 200 severs the strap 120 at a predetermined point short of the deformable retainer 130 (FIG. 13). After the strap 120 is severed, the free end 122 of the strap 120 is positioned between the opening 132 and the strapping supports 133 (FIG. 14). A retainer deformation tool 300, such as a screwdriver, bends the deformable retainer 130 against the free end 122 of the strap 120 to secure the free end 122 of the strap 120, causing the free end 122 of the strap 120 to bend over the inner edge of the bridge 140 and curl in the deformable retainer 130 (FIGS. 15-19), which results in improved pull out resistance and tensile strength.

While this invention has been described in conjunction with the exemplary embodiments outlined above, various alternatives, modifications, variations, and/or improvements, whether known or presently unforeseen, may become apparent. Accordingly, the exemplary embodiments of the invention as set forth above are intended to be illustrative, not limiting. Various changes may be made without departing from the spirit and scope of the invention.

The invention claimed is:

1. A fastener comprising:

a strap; and a buckle for fastening opposing ends of the strap, the buckle comprising:

a deformable retainer defining an entrance passageway for a free end of the strap, the deformable retainer including a retainer tab, an opening adjacent the retainer tab, and a pair of non-deformable strapping supports disposed between the opening and the entrance passageway, the non-deformable strapping supports formed by bending corresponding portions of the deformable retainer toward each other; and a bridge defining an exit passageway for the free end of the strap, wherein the free end of the strap is positionable around an object and consecutively through the entrance passageway and the exit passageway, and wherein the bridge, the non-deformable strapping supports, and the opening are arranged such that, when the free end of the strap bends over the bridge and between the non-deformable strapping supports and the opening, the non-deformable strapping supports cause the free end of the strap to curl when the deformable retainer is deformed.

2. The fastener of claim 1, wherein the deformable retainer is rotatably deformable about an axis of rotation.

3. The fastener of claim 2, wherein the strapping supports are disposed along an axis parallel to the axis of rotation of the deformable retainer.

4. The fastener of claim 2, wherein each of the strapping supports is rotatably formed about an axis of rotation perpendicular to the axis of rotation of the deformable retainer.

5. The fastener of claim 1, wherein the retainer tab is disposed on a distal end of the deformable retainer.

6. The fastener of claim 1, wherein the strapping supports are rotatably formed in opposite directions.

7. The fastener of claim 1, wherein the bridge includes a plurality of teeth.

8. The fastener of claim 7, wherein the teeth are inset relative to the exit passageway.

9. The fastener of claim 1, wherein the buckle is made of metal.

10. The fastener of claim 1, wherein the buckle is made of stainless steel.

* * * * *